US006268802B1

(12) United States Patent
Foladare et al.

(10) Patent No.: US 6,268,802 B1
(45) **Date of Patent: *Jul. 31, 2001**

(54) PERSONAL REACH SYSTEM WITH IMPROVED PAGING CAPABILITIES

(75) Inventors: Mark Jeffrey Foladare, Kendall Park; Shelley B. Goldman, East Brunswick; David Phillip Silverman, Somerville; Roy Philip Weber, Bridgewater, all of NJ (US)

(73) Assignee: AT&T Corp., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/801,448

(22) Filed: Feb. 18, 1997

(51) Int. Cl.[7] ..... G08B 5/22

(52) U.S. Cl. ..... 340/825.44; 340/825.14; 340/311.1; 455/456; 455/457; 455/458; 455/38.1

(58) Field of Search ..... 340/825.448, 825.14, 340/311.1; 455/456, 457, 458, 38.1

(56) References Cited

U.S. PATENT DOCUMENTS 4,757,267 * 7/1988 Riskin ..... 379/201
5,247,700 * 9/1993 Wohl et al. ..... 455/552
5,311,569 * 5/1994 Brozovich et al. ..... 379/45
5,369,681 * 11/1994 Boudreau et al. ..... 340/825.44
5,408,683 * 4/1995 Ablay et al. ..... 455/456
5,481,258 * 1/1996 Fawcett et al. ..... 340/825.14
5,506,897 * 4/1996 Moore et al. ..... 379/201
5,659,596 * 8/1997 Dunn ..... 455/456
5,684,859 * 11/1997 Chanroo et al. ..... 455/456
5,797,097 * 8/1998 Roach, Jr. et al. ..... 455/456

* cited by examiner

*Primary Examiner*—Brian Zimmerman
*Assistant Examiner*—Yves Dalencourt
(74) *Attorney, Agent, or Firm*—Kenyon & Kenyon

(57) ABSTRACT

In order to minimize the number of transmitters from which a page is transmitted in a Personal Reach System in which a subscriber is paged to alert him or her of a waiting telephone call, the subscriber's last known location, the time at her or she was located there, and the elapsed time since being located there, are used to determine an outer perimeter of the geographic area in which the subscriber is likely to be presently located. A page is then transmitted to the subscriber from those transmitters which cover that geographic area. If the elapsed time is more than a predetermined threshold, during which period the subscriber could have traveled anywhere, a nationwide page, rather than a localized page, is transmitted.

25 Claims, 2 Drawing Sheets

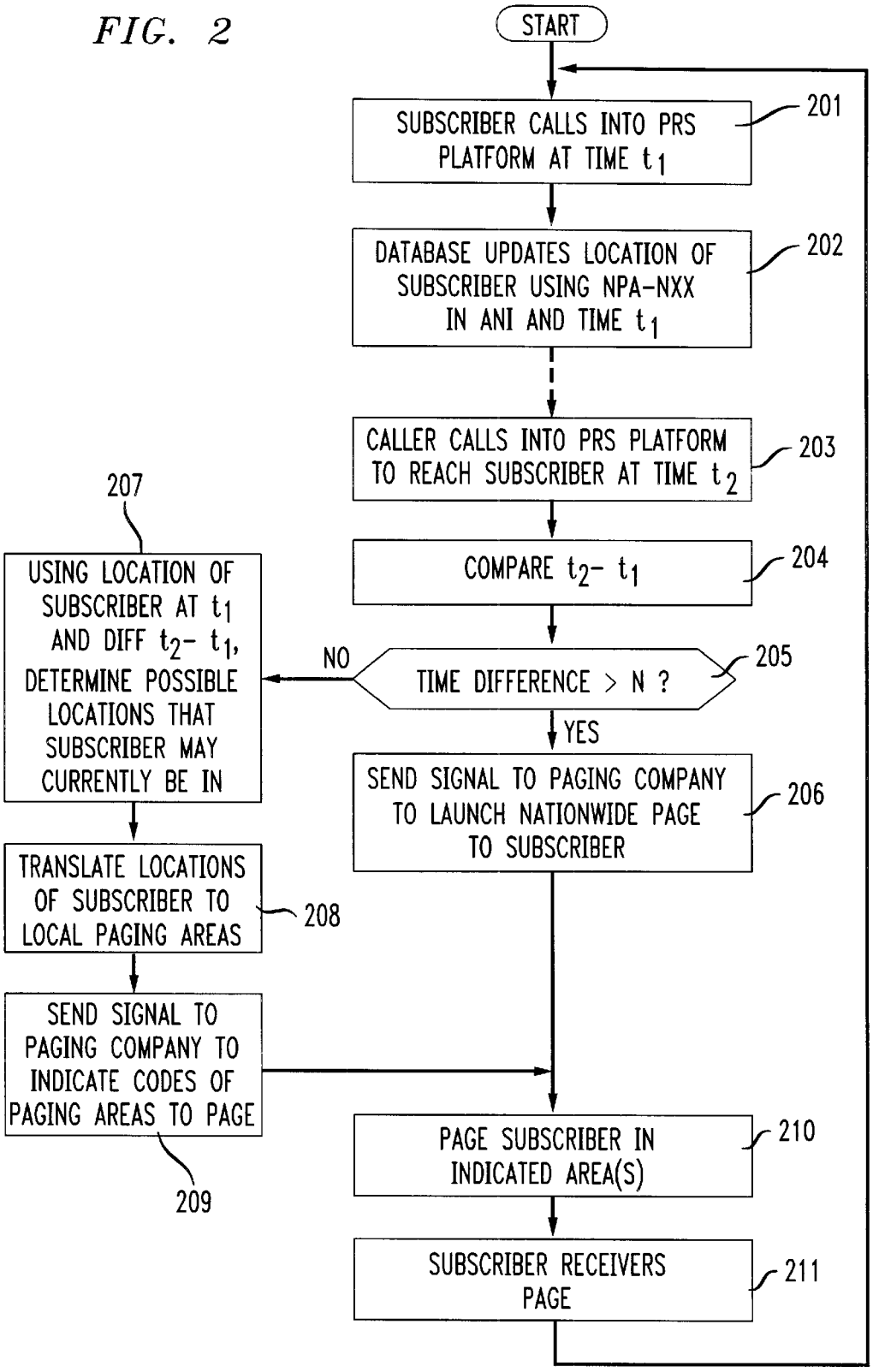
FIG. 2
START
SUBSCRIBER CALLS INTO PRS PLATFORM AT TIME $t_1$
201
DATABASE UPDATES LOCATION OF SUBSCRIBER USING NPA-NXX IN ANI AND TIME $t_1$
202
CALLER CALLS INTO PRS PLATFORM TO REACH SUBSCRIBER AT TIME $t_2$
203
COMPARE $t_2 - t_1$
204
TIME DIFFERENCE > N ?
205
NO
YES
SEND SIGNAL TO PAGING COMPANY TO LAUNCH NATIONWIDE PAGE TO SUBSCRIBER
206
207
USING LOCATION OF SUBSCRIBER AT $t_1$ AND DIFF $t_2 - t_1$, DETERMINE POSSIBLE LOCATIONS THAT SUBSCRIBER MAY CURRENTLY BE IN
TRANSLATE LOCATIONS OF SUBSCRIBER TO LOCAL PAGING AREAS
208
SEND SIGNAL TO PAGING COMPANY TO INDICATE CODES OF PAGING AREAS TO PAGE
209
PAGE SUBSCRIBER IN INDICATED AREA(S)
210
SUBSCRIBER RECEIVERS PAGE
211

PERSONAL REACH SYSTEM WITH IMPROVED PAGING CAPABILITIES

TECHNICAL FIELD

This invention relates to a Personal Reach Service (PRS) in which a subscriber is alerted to a waiting call by a wireless page, and more specifically to a method for improving the efficiency of such paging.

BACKGROUND OF THE INVENTION

In a Personal Reach Service, a calling party places a telephone call to a subscriber's PRS telephone number, which typically may be a call to an "800" number. If the PRS call is placed to an "800" number, a Network Control Point (NCP) translates the dialed 800 number into a conventional NPA+NXX+XXXX telephone number and routes the call to an adjunct connected to the network, which contains bridging and signaling units for providing this service. If not an 800 number call, but a conventional POTS call, the subscriber's call is directly connected to this adjunct. At a bridging and signaling unit at this adjunct, the identity of the subscriber with whom which the calling party wants to communicate is determined from the number dialed by the calling party, or through the inputting by the calling party of the subscriber's code or name via touch-tone inputs or using voice-recognition techniques. Using the subscriber's identity as a database locator, the identity of the subscriber's paging company and the Capcode that identifies that subscriber's pager is retrieved. A signal is then sent to the identified paging company to initiate the broadcast of a wireless page to the identified called subscriber's pager. The subscriber, upon receiving the page and wishing to talk to the calling party, places a revertive call to the adjunct. After the revertive call is associated with the subscriber at the adjunct through the entry by the subscriber of a touch-tone sequence, for example, the calling party's waiting call and the subscriber's revertive call are bridged together. With such a system, the subscriber can be reached wherever his or her pager is capable of receiving the paging company's signal and the subscriber is proximate to a telephone to be able to place the revertive telephone call.

Generally, upon receiving a signal from the network adjunct to initiate a page to an identified subscriber, the paging company launches a nationwide page. Since the subscriber is in only one place at any given time, the pages to the subscriber's pager broadcasted by the plurality of local transmitters across the nation, except for the page in the one area in which the subscriber is actually located, are a waste of resources. These "wasted" pages increase traffic and thus the paging interval at each of the local paging transmitters. The paging interval is that time difference between when a message packet is received by a paging transmitter and placed in a queue for transmission, and when that message packet is served from the queue and actually transmitted by the transmitter.

SUMMARY OF THE INVENTION

In accordance with the present invention, a subscriber to a Personal Reach Service is paged only in the local area in which he or she is likely to be at that time, the latter being determined as a function of that subscriber's last known location and the amount of time that has elapsed since being located that last known location. That last known location is determined as of the time the subscriber was last connected to the network and was identified both as to person and location. Such last call could be to the PRS adjunct to respond to a page in a previous PRS call, or any call to a network platform to place a call, to receive messages, or otherwise, in which the identity of the subscriber can be determined and, from the Automatic Number Identification (ANI) or other mechanism, from which the geographic location of the subscriber at that previous time can be determined. That last known location of the subscriber can also be determined from any mechanism in which the subscriber's identity and location can be ascertained and that information provided to the network, and from there to the adjunct. Using that previous location of the subscriber and the time at which the subscriber was located there, the outer perimeter defining the geographic area within which the subscriber is at present most likely to be located is identified and the subscriber is paged only by those local transmitters that cover that area. If more than a predetermined time has elapsed since the subscriber's location was last identified, during which interval the subscriber could in fact have traveled anywhere within or even outside the nation, then a nationwide page is launched to the subscriber. Advantageously, if only a short time has elapsed since the subscriber was last located, a subsequent page to the subscriber can be localized within that same paging area and, depending upon the magnitude of the elapsed time, within nearby adjacent areas. Thus, pages need not be transmitted from transmitters in areas in which the subscribers presence is highly unlikely based on the subscriber's last known location and the time elapsed since the subscriber's presence at that location was determined. Local transmitters are thus able to operate at a more efficient level.

BRIEF DESCRIPTION OF THE DRAWINGS

FIG. 2 is a flowchart detailing the steps of the present invention.

DETAILED DESCRIPTION

Figure 1:
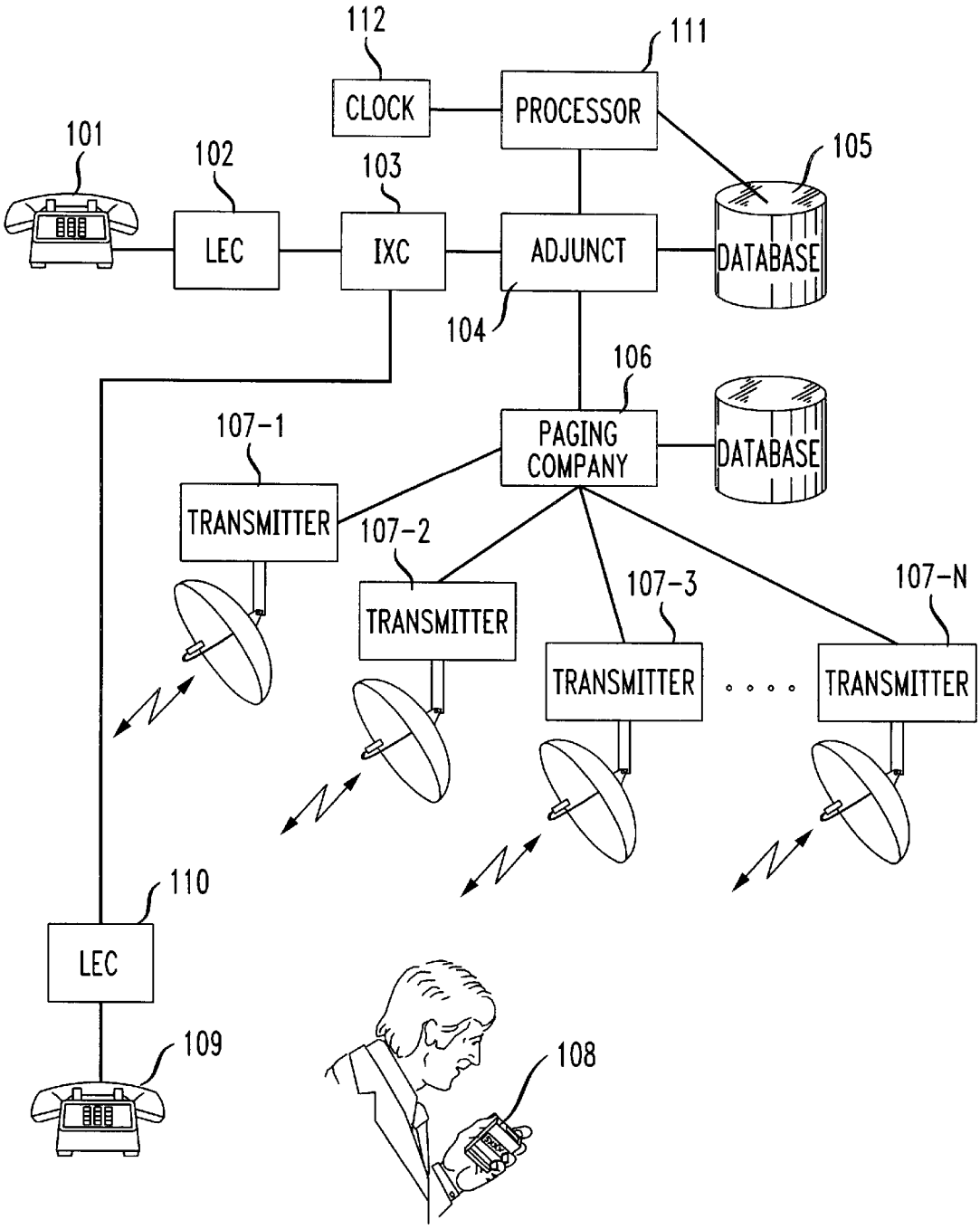
FIG. 1 is a block diagram of PRS system that pages the subscriber based on his or her last known location, in accordance with the present invention.

With reference to FIG. 1, a calling party at station set 101 dials a subscriber's PRS telephone number in an attempt to reach that subscriber wherever the subscriber may then be. That call is connected through the calling party's Local Exchange Carrier (LEC) network 102 and the Interexchange Carrier (IXC) network 103 to an adjunct 104 that performs the functions of identifying the subscriber, initiating a wireless page to the identified subscriber, receiving a revertive call from the subscriber, associating the revertive call with the subscriber's identity, associating the revertive call with the calling party's call, and bridging both calls together. The calling party can reach the adjunct by dialing an 800 number uniquely associated with the subscriber, in which case the dialed 800 number is directed to an Network Control Point (NCP) (not shown) where the 800 number is translated to a NPA+NXX+XXXX number associated with the adjunct. The call is then routed to that number. Alternatively, the calling party can reach adjunct 104 by directly dialing an NPA+NXX+XXXX number of the adjunct. Adjunct 104 contains a plurality of bridging and signaling units (not shown), each of which in turn includes a meet-me type of bridge. If the dialed 800 number is uniquely identified with the subscriber, when the calling party's call is connected to adjunct 104, the identity of the subscriber that the calling party is attempting to reach is determined from the number dialed by the calling party, as provided by IXC network 103 using Dialed Number Identification Service (DNIS). If adjunct 104 is reached, however, through a number shared by a plurality of subscribers, then the calling party, upon connection to adjunct 104, provides the subscriber's identity using conventional caller-interactive technology, such as the input of a touch-tone sequence or voice-recognition techniques. Using the identity of the subscriber as a database input, adjunct 104 retrieves from its associated database 105, that subscriber's paging company and pager-identifying Capcode.

In accordance with the invention, in addition to providing the Capcode of the subscriber's pager to be paged to the paging company 106, adjunct 104 also provides additional information to paging company 106 that identifies the specific transmitters through which the subscriber is to be paged. Specifically, codes of those specific transmitters 107-1–107-N, which are located around the nation and which are associated with different paging areas, are transmitted in the signal from adjunct 104 to paging company 106. Paging company 106 then transmits a paging signal to each of the identified local transmitters so each can initiate a wireless page to the identified subscriber's pager having the provided Capcode.

Upon receiving the signal directed to it from the most proximate transmitter, such as transmitter 107-2 for example, the subscriber's pager 108 emits an auditory or sensory signal which is recognized by the subscriber as an indication of a waiting call. The subscriber can then place a revertive call from a nearby telephone station set 109, through the local LEC network 110 and IXC network 103 to adjunct 104. Using either the number dialed by the subscriber, such as an 800 number associated only with the subscriber, or through an interactive transaction between the subscriber and the adjunct 104, during which through the inputting by the subscriber of an identifier using touch-tone signals or through voice recognition, adjunct 104 associates the revertive call with the subscriber and thus with the call for that subscriber from the calling party at station 101 then being kept on hold. The two calls are then bridged together, allowing communication to proceed between the calling party at station 101 and the subscriber at station 109.

When the subscriber places the revertive call from station set 109 through the LEC network 110 to adjunct 104, the area code (NPA) and exchange (NXX) of station 109 from the Automatic Number Identification (ANI) signal are also forwarded. Using the received NPA and NXX, a processor 111 associated with adjunct 104 determines the approximate geographic location of the subscriber at station 109. That geographic location, together with the time of the system clock 112 when the subscriber is located there is stored in database 105 in a record associated with the subscriber's identity. When the same or a different calling party subsequently places another PRS call to that subscriber, which call is connected to adjunct 104, that record in database 105 is retrieved to determine the last known location of the subscriber and the time at which the subscriber was known to be there. Then, using the current time on system clock 112, the elapsed time since the subscriber's location was last determined is calculated. Further, using the last known location of the subscriber, a stored representation of the paging service area, and the elapsed time, processor 111 determines the outer perimeter of an area within which the subscriber would likely now be located. Such area can be determined using the last known location and the time that has elapsed since being located there by using assumptions for a maximum rate of speed for a subscriber traveling by automobile, and any characteristics of the last known location of the subscriber and the current time. As an example of the latter, the area within which a subscriber can travel from mid-town Manhattan within one-half hour during rush hour at 5:00 PM is significantly different in size than at 2:00 AM in the morning. Using the geographic area within that outer perimeter and the coverage areas of the local transmitters 107-1–107-N, processor 111 determines which local transmitters should be signaled to page the subscriber who is likely to be within the merged paging areas. Codes representing those local transmitters are transmitted to paging company 106. In response to those codes, paging company 106 transmits signals to those particular transmitters, providing to those transmitters the Capcode of the identified subscriber's pager 108.

If the elapsed time since the subscriber was last located is short, the outer perimeter within which the subscriber is likely to be currently located can readily be determined. As the elapsed time increases, the area widens. When the elapsed time exceeds a predetermined threshold, the likelihood increases that subscriber might have traveled anywhere, given the possibility of air travel. Thus, when the elapsed time exceeds such predetermined threshold, a nationwide page is launched to ensure that a paging signal does in fact reach the subscriber's pager. Such maximum elapsed time threshold could be a fixed duration, or could be dependent upon the subscriber's last location and/or the current and/or the previous time of day. Thus, for example, if the last known location of the subscriber was midtown Manhattan, and the next PRS call is received one hour thereafter, the subscriber would not be likely to have gone beyond the tri-state metropolitan area. If, however, the last known location of the subscriber was determined to be in a less congested area from which the subscriber, within the elapsed time, could have readily boarded an airplane and be en route anywhere, a nationwide page will be broadcast. Further, depending on the complexity of the algorithm implemented, various factors could be used by one skilled in the art to determine the geographic area within which the subscriber might likely currently be located based on the subscriber's last known location, the elapsed time since being at that last known location, the time of day at that last known location, and the current time of the day.

The subscriber's last known location, as described hereinabove, is determined when he or she last placed a revertive call to the adjunct 104 to meet a previous PRS call. The subscriber's location can also be determined when he or she accessed that adjunct to place a call through the adjunct, or to retrieve his voicemail messages through that adjunct. The location could also be determined when the subscriber places a wireless phone call through the telephone network from the Mobile Telephone Switching Office (MTSO) through which the wireless phone call is routed. Any connection of the subscriber to the network from which his or her identity and location can be determined, can be used to convey that information through the adjunct 104 to processor 111 for storage in database 105. This could also include access through the network to the Internet. Also, if the subscriber makes a purchase using a credit card, or uses a smart card, from which usage a location of the subscriber can be determined and then reported over a Wide Area Network, or otherwise, to adjunct 104 and processor 111 for recording as the subscriber's last known location in the subscriber's record in database 105. From wherever and however the last known location of the subscriber is determined, such last known location can be provided to adjunct for entry into the location field of that subscriber's record in database 105 and then used subsequently to localize the areas in which the subscriber is to be paged.

With reference to FIG. 2, a flowchart is shown illustrating the steps of the present invention. At step 201, the subscriber calls into the PRS platform at time $t_1$ and the subscriber's locations determined. As previously noted, such call can be a revertive call in response to a page, or a call to initiate another call. Step 201 could also be a credit card transaction by the subscriber with a merchant in which the location of the merchant is provided, or usage by the subscriber of a smart card. At step 202, the last location field in a record associated with the subscriber in the database 105 is updated using the NPA-NXX portion the ANI and the time field is updated to time $t_1$. Between steps 202 and 203 an indefinite time period passes. At step 203, at time $t_2$, a caller places a PRS call to reach the subscriber. At step 204, the difference between times $t_2$ and $t_1$ is calculated. If such difference exceeds a threshold N at step 205, then at step 206 a signal is sent to the paging company indicating that a nationwide page should be broadcast to the subscriber. If at step 205, the difference is less than the threshold N, then at step 207 the area within which the subscriber is likely to be located is determined based on the combination of his or her previous location as stored in the location field, and the time difference $t_2$–$t_1$. At step 208, that area is translated into local paging areas, and at step 209 a signal is sent to the paging company indicating the codes of the paging areas in which transmitters are to transmit a page to the subscriber. At step 210, the subscriber is paged, either nationwide or within the specified paging areas. After some paging interval, at step 211, the page is broadcast and the subscriber's pager receives the page. The subscriber then calls into the PRS platform to bridge to the waiting call. When doing so, back at step 201, the subscriber's now newly determined location is stored in the location field in the subscriber's record in the database and the time of that revertive call, stored in an associated time field.

The above-described embodiment is illustrative of the principles of the present invention. Other embodiments may be devised by those skilled in the art without departing from the spirit and scope of the present invention.

The invention claimed is:

1. In a paging system which transmits a wireless page message to a subscriber unit from a plurality of geographically distributed transmitters, a method of paging the subscriber unit at a current time comprising the steps of:

determining a location of the subscriber unit at a previous time, the location being derived from an Automatic Number Identifier of an out-of-system telephone station set from which a user of the subscriber unit previously accessed the paging system;

determining an elapsed time between the current time and the previous time;

determining a geographic area within which the subscriber unit is likely to be at the current time, based on said elapsed time and said location of the subscriber unit at the previous time; and paging the subscriber unit from those transmitters which cover the geographic area within which the subscriber unit is determined to likely be.

2. The method of claim 1 wherein the location of the subscriber at the previous time is determined when the subscriber is connected at the previous time to a telecommunications network to which the paging system is connected and the location of the subscriber is determined.

3. The method of claim 2 wherein the location of the subscriber at the previous time is determined when the subscriber places a revertive telephone call over the telecommunications network to a personal reach system in response to a previous page.

4. The method of claim 2 wherein the location of the subscriber at the previous time is determined when the subscriber places a telephone call over the telecommunications network.

5. The method of claim 1 wherein the location of the subscriber at the previous time is determined when the subscriber pays for a transaction using a credit card at the previous time.

6. The method of claim 2 wherein the location of the subscriber at the previous time is determined as a result of the subscriber making a connection through the telecommunications network to the Internet.

7. The method of claim 1 wherein when the elapsed time is greater than a predetermined threshold, the page is transmitted to the subscriber by each of the plurality of transmitters.

8. The method of claim 1 wherein the current time together with the elapsed time and the location of the subscriber at the previous time are used to determine the geographic area within which the subscriber is likely to be at the current time.

9. The method of claim 7 wherein the predetermined threshold is a function of the location of the subscriber at the previous time.

10. The method of claim 7 wherein the predetermined threshold is a function of the elapsed time.

11. The method of claim 7 wherein the predetermined threshold is a function of the previous time.

12. The method of claim 7 wherein the predetermined threshold is a function of the current time.

13. In a personal reach system in which at a current time a subscriber unit is paged with a page message indicating the presence of a waiting telephone call on a telecommunications network and in which, when the user places a revertive call to a network adjunct and is identified to the adjunct, the revertive call and the waiting call are bridged, a method paging of the subscriber unit comprising the steps of:

determining a location of the subscriber unit at a previous time, the location being derived from an identifier of an independent communication device from which a user of the subscriber unit previously made a revertive call;

determining an elapsed time between the current time and the previous time;

determining a geographic area within which the subscriber unit is likely to be at the current time, based on said elapsed time and said location of the subscriber unit at the previous time;

determining from a plurality of geographically distributed paging transmitters which transmit the page messages, the particular paging transmitters that cover the geographic area within which the subscriber unit is determined to likely be; and transmitting a signal to initiate a page to the subscriber unit from each of the particular paging transmitters that are determined to cover the geographic area within which the user of the subscriber unit is determined to likely be.

14. The method of claim 13 wherein the location of the subscriber at the previous time is determined when the subscriber is connected to the telecommunications network at the previous time and the location of the subscriber at that previous time is determined by the telecommunications network.

15. The method of claim 14 wherein the location of the subscriber at the previous time is determined when the subscriber places a revertive call in response to a page at the previous time.

16. The method of claim 14 wherein the location of the subscriber at the previous time is determined when the subscriber places a telephone call over the telecommunications network at the previous time.

17. The method of claim 13 wherein the location of the subscriber at the previous time is determined when the subscriber pays for a transaction with a credit card at the previous time.

18. The method of claim 14 wherein the location of the subscriber at the previous time is determined as a result of the subscriber making a connection through the telecommunications network to the Internet.

19. The method of claim 13 wherein when the elapsed time is greater than a predetermined threshold, a signal to initiate a page to the subscriber is transmitted to each of the plurality of paging transmitters.

20. The method of claim 13 wherein the current time together with the elapsed time and the location of the subscriber at the previous time are used to determine the geographic area within which the subscriber is likely to be at the current time.

21. The method of claim 19 wherein the predetermined threshold is a function of the location of the subscriber at the previous time.

22. The method of claim 19 wherein the predetermined threshold is a function of the previous time.

23. The method of claim 19 wherein the predetermined threshold is a function of the elapsed time.

24. The method of claim 19 wherein the predetermined threshold is a function of the current time.

25. In a system in which a subscriber unit is paged to alert a user of the subscriber unit of the occurrence of an event, a method of paging the subscriber unit comprising the steps of:

determining a location of the subscriber unit at a previous time, the location being derived from an Automatic Number Identifier of an out-of-system telephone station set from which a user of the subscriber unit previously accessed the paging system;

determining an elapsed time between the current time and the previous time;

determining a geographic area within which the subscriber unit is likely to be at the current time, based on said elapsed time and said location of the subscriber unit at the previous time;

determining from a plurality of geographically distributed paging transmitters which transmit the pages to subscriber units, the particular paging transmitters that cover the geographic area within which the subscriber unit is determined to likely be; and transmitting a signal to initiate a page to the subscriber unit from each of the particular paging transmitters that are determined to cover the geographic area within which the subscriber unit is determined to likely be.

* * * * *